US006460849B1

(12) United States Patent
Bean

(10) Patent No.: US 6,460,849 B1
(45) Date of Patent: Oct. 8, 2002

(54) ROTATING RING GAME

(76) Inventor: Jeffrey W. Bean, 27 Minerva Ave., Sanford, ME (US) 04073

( * ) Notice: Subject to any disclaimer, the term of this patent is extended or adjusted under 35 U.S.C. 154(b) by 0 days.

(21) Appl. No.: 09/525,794

(22) Filed: Mar. 15, 2000

Related U.S. Application Data

(60) Provisional application No. 60/124,639, filed on Mar. 16, 1999.

(51) Int. Cl.[7] ..... A63F 9/08

(52) U.S. Cl. ..... 273/155; 273/241; 273/271

(58) Field of Search ..... 273/155, 241, 273/271

(56) References Cited

U.S. PATENT DOCUMENTS

| | | | | | |
|---|---|---|---|---|---|
| 3,659,285 | A | * | 4/1972 | Baer et al. | 340/324 A |
| 3,684,290 | A | | 8/1972 | Wayne | 273/143 C |
| 4,099,722 | A | | 7/1978 | Rodesch et al. | |
| 4,560,164 | A | | 12/1985 | Darling | |
| 4,632,399 | A | | 12/1986 | Bern | |
| 4,651,992 | A | * | 3/1987 | Danino et al. | 273/155 |
| 4,723,776 | A | * | 2/1988 | Bean | 273/1 G |
| 4,732,386 | A | * | 3/1988 | Rayfiel | 273/142 H |
| 4,817,952 | A | | 4/1989 | Biro et al. | 273/153 S |
| 4,836,540 | A | * | 6/1989 | Bean | 273/1 G |
| 4,911,448 | A | * | 3/1990 | Thomas | 273/142 R |
| 5,209,708 | A | * | 5/1993 | Igaku | 475/156 |
| 5,239,452 | A | * | 8/1993 | Chen | 362/293 |
| 5,504,637 | A | * | 4/1996 | Asada et al. | 360/98.07 |
| 5,634,641 | A | * | 6/1997 | Roman | |
| 5,788,232 | A | * | 8/1998 | Binkley | 273/155 |

* cited by examiner

*Primary Examiner*—Benjamin H. Layno
*Assistant Examiner*—Dolores R. Collins
(74) *Attorney, Agent, or Firm*—Fish & Richardson P.C.

(57) ABSTRACT

A two-player game combining an assembly of ring-form components modifiable by the rotation and sliding of two handles. The game has first and second handles separated by a series of rotatable game rings. Each game ring bears a pattern of selected indicia about its circumference. Game ring engagement members associated with the handles are constructed for engagement with and rotation of selected of the game rings to align selected of the indicia thereon with indicia on adjacent game rings, by pushing, pulling and rotating movement of the handles about a central common axis, each game rings being free to rotate about the central common axis and held by a series of stationary spacer rings. In one preferred embodiment, an electronic indicator circuit detects occurrence of a predetermined desired alignment of indicia and emits a signal thereupon.

14 Claims, 10 Drawing Sheets

ROTATING RING GAME

This application claims the benefit of provisional application No. 60/124,639 filed Mar. 16, 1999.

TECHNICAL FIELD

This invention relates to games for two players.

BACKGROUND

Rotating ring games are known from my prior patents, Bean U.S. Pat. No. 4,723,776 and Bean U.S. Pat. No. 4,836,540, over which the present invention represents an improvement. The complete disclosures of these patents are incorporated herein by reference and provide the basis for the instant application.

SUMMARY

The invention relates to a competitive rotating ring game device which permits two competitors, by rotating and sliding handles at opposite ends of a series of individually rotatable rings, to compete against each other for the purpose of aligning indicia, such as pre-chosen colors, spaced about the peripheries of the rings.

A rotating ring game of one embodiment of the invention consists of a series of side-by-side game rings mounted for rotation about a central axis. The exposed cylindrical surface of each ring is covered by series of areas of different colors, shapes and/or design, e.g., printed, molded or similarly affixed. Each ring is unique as to the type of game involved, e.g., educational game (letters, numerals, etc.), competitive game and/or puzzle (swords, tanks, etc.) or simply selected colors. The game rings are controlled by two handles, one for each player, extending from opposite ends of the aligned series of rings. An extension of each handle, comprising a ring-actuating member having a ring-actuating tab on its distal end, extends axially within the series of rings from each handle and may be rotated and/or moved lengthwise in either direction by the handle. When the handle and extension are rotated, the tab engages and rotates, by one step, the game ring within which it is located at the moment. Correspondingly, when the handle is moved lengthwise, in either direction, the tab will be positioned to control a different game ring. Each player may, through his handle, control any one or two rings at any moment, except for a ring then being controlled by his opponent. Thus, the player gains control of desired specific ring(s) by pushing or pulling his handle until the actuating tab has registered with the desired ring(s) whereupon he may rotate that ring by rotating the handle. Once the ring(s) is rotated, which may be step-by-step, he is ready to push or pull his handle to shift his actuating tab to another ring(s) in order to make another move.

According to one aspect of the invention, a two player game combining an assembly of ring-form components modifiable by the rotation and sliding of two handles comprises first and second handles separated by a series of rotatable game rings, each rotatable game ring in the series of rotatable game rings bearing a pattern of selected indicia about its circumference, first and second game ring engagement members associated with the first and second handles, respectively, and constructed for engagement with and rotation of selected of the rotatable game rings to align selected of the indicia thereon with indicia on adjacent rotatable game rings, by pushing, pulling and rotating movement of the first and second handles about a central common axis, each of the rotatable game rings being free to rotate about the central common axis and held by a series of stationary spacer rings, and an electronic indicator circuit adapted to detect occurrence of a predetermined desired alignment of the indicia and to emit a signal thereupon.

Preferred embodiments of this aspect of the invention may include one or more of the additional features. Each of the rotatable game rings defines a set of apertures arranged in an aperture pattern corresponding to the pattern of selected indicia about its circumference, and the electronic indicator circuit is adapted to emit the signal when apertures of the series of rotatable game rings are arranged in a predetermined aperture pattern indicating occurrence of the predetermined desired alignment of the indicia. The electronic indicator circuit comprises a beam emitter and a beam detector, the beam emitter and the beam detector being mounted to the game with the series of rotatable game rings disposed therebetween, and the predetermined aperture pattern indicating occurrence of the predetermined desired alignment of the indicia being positioning of the apertures in a line between the beam emitter and the beam detector. Preferably, the line between the beam emitter and the beam detector is disposed generally parallel to the central common axis of the series of rotatable game rings. The beam emitter comprises an LED emitter and the beam detector comprises an LED detector, the LED detector being positioned to detect an emission from the LED emitter, thereby closing the electronic indicator circuit, when the apertures of the series of rotatable game rings are arranged in the predetermined aperture pattern indicating occurrence of the predetermined desired alignment of the indicia. The electrical indicator is a piezo buzzer for emitting a sound to indicate the predetermined desired alignment. The game further comprises a hilt defining a first surface for gripping by a first player to steady and position the two player game during play and defining a second surface for gripping by a second player to steady and position the two player game during play. The first and second game ring engagement members are extensions of the associated first and second handles, respectively, each comprising an elastically flexible cantilevered member having a distal actuator portion adapted for engagement with the selected of the rotatable game rings, the distal actuator portion and the rotatable game rings define cooperative interengagement structure, and the elastically flexible cantilevered member is adapted, upon encounter with a predetermined resistance force to rotation of an engaged rotatable game ring, to deflect radially inward, relative to the common central axis, with disengagement of the cooperative engagement structure of the distal actuator portion and the rotatable game rings and to elastically recover radially outward to re-engage the cooperative engagement structure of the distal actuator portion and the rotatable game rings. Preferably, the predetermined resistance force is created by opposition between the first engagement member associated with the first handle and the second engagement member associated with the second handle.

The first and second game ring engagement members are constructed for selective, simultaneous engagement with and rotation of multiple of the rotatable game rings. The game further comprises first and second externally visible indicator bars coupled to the first and second handles, respectively, and movable therewith in correspondence to the first and second game ring engagement members, each of the first and second externally visible indicator bars comprising a distal indicator portion visually indicating the position of a corresponding distal actuator portion.

According to another aspect of the invention, a two player game combining an assembly of ring-form components modifiable by the rotation and sliding of two handles comprises first and second handles separated by a series of rotatable game rings, each rotatable game ring in the series of rotatable game rings bearing a pattern of selected indicia about its circumference, and first and second game ring engagement members associated with the first and second handles, respectively, and constructed for engagement with and rotation of selected of the rotatable game rings to align selected of the indicia thereon with indicia on adjacent rotatable game rings, by pushing, pulling and rotating movement of the first and second handles about a central common axis, the first and second game ring engagement members being extensions of the associated first and second handles, respectively, each comprising an elastically flexible cantilevered member having a distal actuator portion adapted for engagement with the selected of the rotatable game rings, the distal actuator portion and the rotatable game rings defining cooperative interengagement structure, and the elastically flexible cantilevered member being adapted, upon encounter with a predetermined resistance force to rotation of an engaged rotatable game ring, to deflect radially inward, relative to the common central axis, with disengagement of the cooperative engagement structure of the distal actuator portion and the rotatable game rings and to elastically recover radially outward to re-engage the cooperative engagement structure of the distal actuator portion and the rotatable game rings each of the rotatable game rings being free to rotate about the central common axis and held by a series of stationary spacer rings.

Preferred embodiments of this aspect of the invention may include one or more of the additional features. The predetermined resistance force is created by opposition between the first engagement member associated with the first handle and the second engagement member associated with the second handle.

According to still another aspect of the invention, a two player game combining an assembly of ring-form components modifiable by the rotation and sliding of two handles comprises first and second handles separated by a series of rotatable game rings, each rotatable game ring in the series of rotatable game rings bearing a pattern of selected indicia about its circumference, first and second game ring engagement members associated with the first and second handles, respectively, and constructed for engagement with and rotation of selected of the rotatable game rings to align selected of the indicia thereon with indicia on adjacent rotatable game rings, by pushing, pulling and rotating movement of the first and second handles about a central common axis, the first and second game ring engagement members being extensions of the associated first and second handles, respectively, each comprising an elastically flexible cantilevered member having a distal actuator portion adapted for engagement with the selected of the rotatable game rings, and first and second externally visible indicator bars coupled to the first and second handles, respectively, and movable therewith in correspondence to the first and second game ring engagement members, each of the first and second externally visible indicator bars comprising a distal indicator portion visually indicating the position of a corresponding distal actuator portion.

The object of the game is to align a chosen color(s), shape(s) or design(s) in an axial direction over the playing surface before an opponent does likewise. It should be noted that the object of the game can be unique to each specific version of the game.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

The description following refers directly to, and shows, in FIGS. 1–9, a prior version of my rotating ring game, as described in Bean U.S. Pat. No. 4,836,540. Features of an improved version of my rotating ring game are also described, in particular with reference to FIGS. 10 et seq.

Figure 1A:
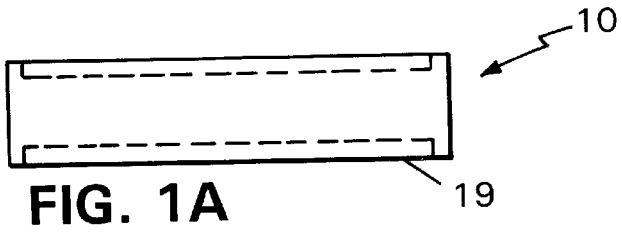
FIGS. 1A, 1B and 1C display, respectively, edge, elevational and cross-sectional views of one of the rotating game rings employed in a presently preferred embodiment of the invention.
Figure 1B:
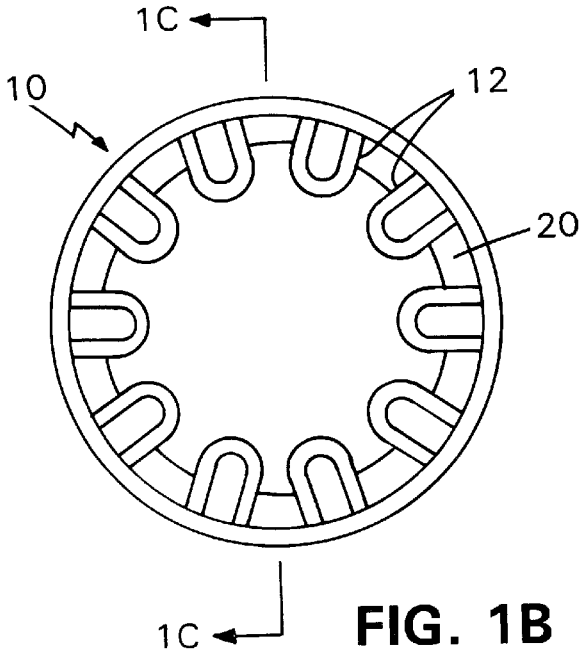
Figure 1C:
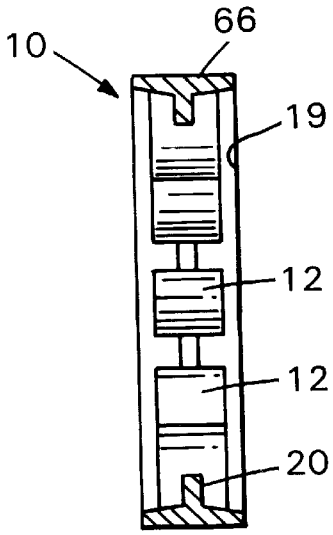
Figure 2C:
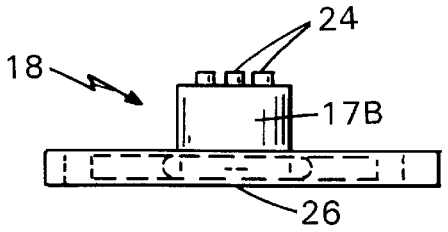
FIGS. 2A, 2B and 2C display, respectively, elevational, cross-sectional and edge views of one of the spacer rings that separate the game rings from each other.
Figure 2A:
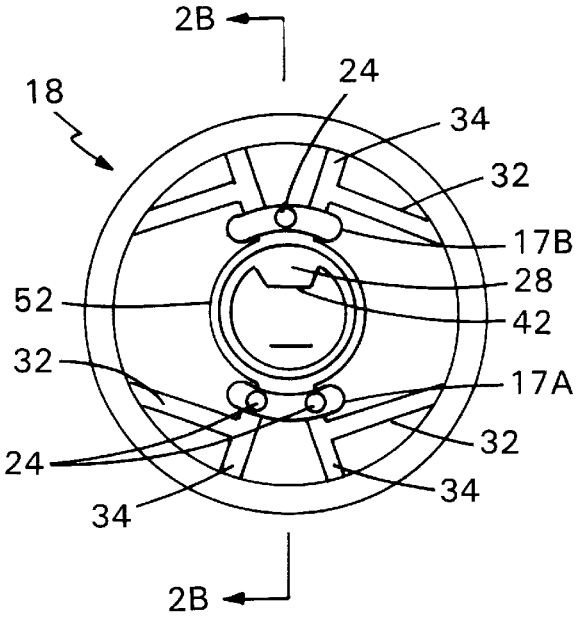
Figure 2B:
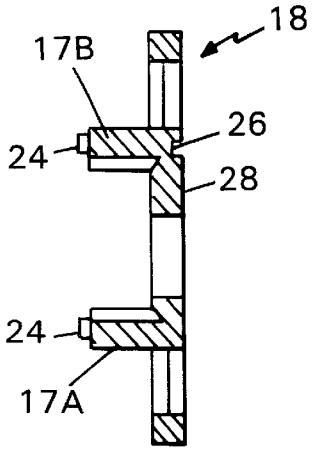
Figure 3:
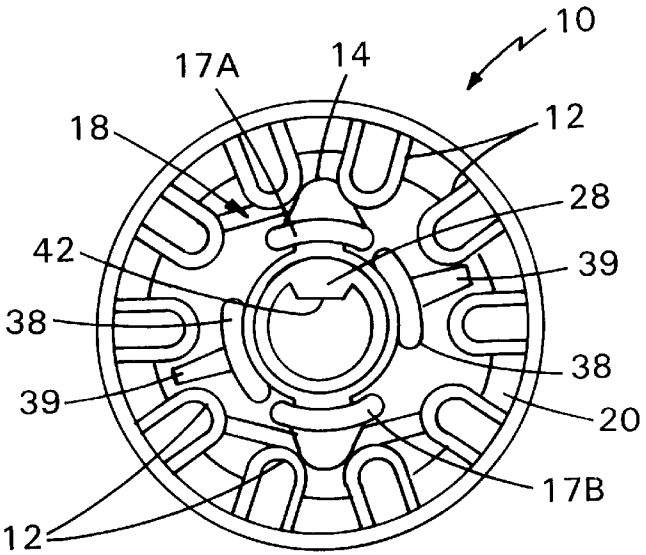
FIG. 3 is an elevational view of a game ring with internal parts shown in assembled condition.

Referring first to FIGS. 1–9, and more particularly to FIGS. 1A, 1B and 1C, the configuration of one of the rotatable game rings 10 is apparent. Any number of these rings, within reason, may be assembled side-by-side, as will later be explained, on the center shaft 30 (FIGS. 4A and 4B), depending on the version of the game. The game ring 10 can be made by an injection molding process. It is provided with a circular array of radially inwardly directed molded teeth 12, in this case ten, but any number of teeth may be used depending on the version of the game, i.e. how many different spaces 66 (FIG. 9) are to appear on the peripheral surface of each ring to be aligned by the players. The number of teeth determines the arc through which the rings can be turned to the left or right at each play. The teeth 12 are rounded so as to accept the spring clips 14 (as seen in FIG. 3). The teeth 12 of each game ring 10 are recessed axially inwardly as indicated at 19. The circular array is recessed slightly less than one-half the thickness of the stationary ring so as to allow a slight gap between the game ring array when the rings and spacers 18 are assembled to prevent their binding against each other. Ridge 20 on the game ring 10 is added to strengthen the part.

Referring to FIGS. 2A, 2B and 2C, it will be seen that each spacer ring 18 may be made in one piece by injection molding. As already mentioned, these interfitting stationary spacer rings separate the rotating rings 10 from each other and are so dimensioned in an axial direction as, when assembled, to allow the rings 10 to rotate freely and independently. These spacer rings connect together, when assembled, into one continuous chain by inserting studs 24 into corresponding holes 26 of the next spacer ring. Two studs 24 are formed on portion 17A of each ring and one stud 24 on portion 17B.

Figure 4B:
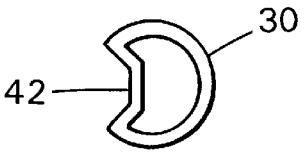
FIGS. 4A and 4B display, respectively, plan and end views of the main center shaft of the device about which the rings are assembled.
Figure 4A:
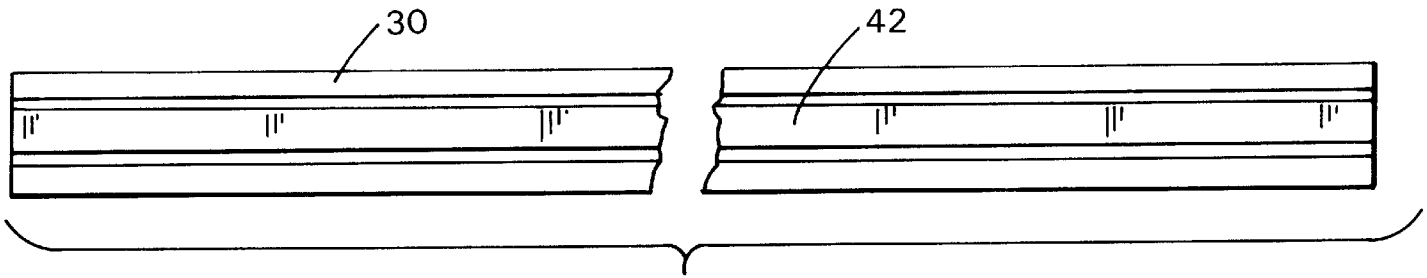

A radially inwardly extending extension 28 within each spacer 18 fits longitudinal groove 42 of central shaft 30 (FIGS. 4A and 4B) whereby all the spacer rings can be aligned for sliding onto and rigidly attaching the spacers to the shaft once the rotating rings and spring clips are in place (FIGS. 3, 4A and 4B).

Figure 5:
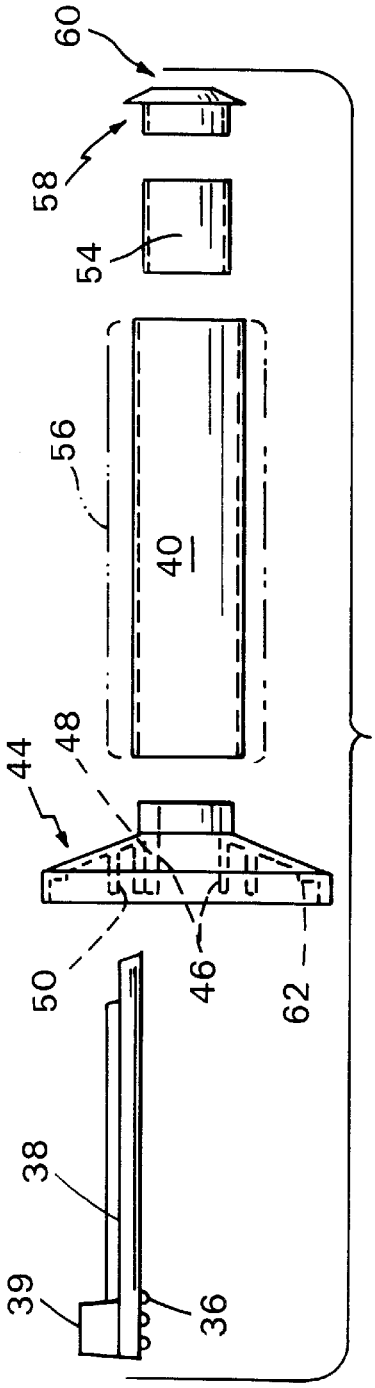
FIG. 5 is an exploded side view of one handle assembly showing the various parts thereof.

Structural members 32, 34 strengthen the spacers and allow for efficient molding. Structural members 34 serve an additional function that of providing a stop, limiting movement of the spring clips 14 in the axial direction. Center ring 52 of each spacer is present not only to provide a stronger part, but, more importantly, to define an axially spaced aligned series of internal radially outwardly facing ridges (FIG. 9) for receiving and accurately positioning the radially inwardly facing ridges 36 formed opposite the actuating tab 39 at the inner end of handle extension 38 (FIG. 5). This simplified and greatly improved construction replaces the ball and guide positioning assembly of my U.S. Pat. No. 4,723,776.

Turning to FIG. 3, a spacer ring 18, game ring 10 and spring clips 14 are shown assembled. The spring clip 14 essentially free floats, engaging between the spacer 18 and the teeth 12 of the rotating ring 10. The engagement of tab 39 of each handle extension 38 with the teeth 12 is as shown.

The center shaft itself 30 is illustrated in FIGS. 4A and 4B. It can be molded in one piece in an extrusion process. The longitudinal groove 42 covers an arcuate distance twice that which separates the teeth 12 of ring 10. For example, teeth 12 are arcuately spaced every 36°. Hence, in this case, the center shaft groove would cover a 72° arc. This relationship is important to the functioning of the game for it permits the proper left and right rotation of the two handles. Also, the rotating ring assembly is assembled with radially inward extensions 28 of spacers 18 in alignment to be slid into this groove. Turning now to FIG. 5, there is shown an exploded side view of one of the two identical handle assemblies. Each is comprised of five components. The first of these is integrally molded handle guard 44. It is the piece on which the rest of the assembly is assembled. To receive the shaft 30 it has an opening 46 that is slightly larger than the diameter of the center shaft 30. The opening 46 is also provided with an internal keyway 48 covering the same arcuate distance as that which separates teeth 12. This allows the handle and, accordingly the rings 10, to rotate one interval at a time to the left or right, the spring clips 14 snapping into place and holding the teeth 12 until another move is made. A bore 50 in handle guard 44 is set 90° to the keyway 48 to receive handle extension 38.

Each handle extension 38 is molded of a suitable resilient plastic in an injection mold. While relatively rigid, this part is sufficiently flexible to bend when the two players have engaged the same rotating ring 10 but to spring back to its original position when the ring has been disengaged. The selection of suitable plastic is within the skill of the art.

Figure 5A:
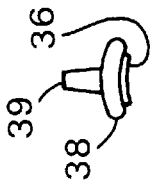
FIG. 5A is an end view of the handle extension as shown at the left side of FIG. 5.

Handle extension 38 carries tab 39 (FIG. 5A), which engages the teeth 12. Opposite tab 39, as mentioned above, three ridges 36 are formed on extension 38, so spaced and sized as to cooperate with rings 52 of the spacers 18 to locate the linear positions of the tab extension within the ring assembly properly with respect to whichever rotating ring or rings 10 the player wishes to engage. As the extension is reciprocated, these ridges ride over and snap into place over the rings 52 as seen in the cutaway view of FIG. 9 for properly positioning the handle assembly in use.

The system just described replaces the ball and guide assembly of my U.S. Pat. No. 4,723,776. The ridges 36 and ring 52 are shown having 30° bevels, but several other configurations could be used, such as rounds, within the discretion of the designer.

The handle 40 (FIG. 5) is also made in an extrusion process. It is a simple tube of such a diameter as to be press-fitted and glued onto handle guard 44. A foam rubber grip 56 is slid onto the handle. It may be of the bicycle grip variety for comfort and appearance. The assembled handle guard 44, handle extension 38 and handle 40 can be slid onto the center shaft 30 before the handle stop 54 is pressed and glued onto the end of center shaft 30. The handle assembly itself is then free to slide back over the handle plug 58 until the end of the handle guard 44 hits the end of handle stop 54. This prevents the handle assembly from coming off the shaft 30 and also stops the assembly in the proper position for tab 39 to engage the end-most rotating ring 10. Handle plug 58 is then glued into the end of handle 40. A bore 60 in the end of the plug 58 permits attachment of a strap to encircle the player's wrist while playing the game.

Figure 6:
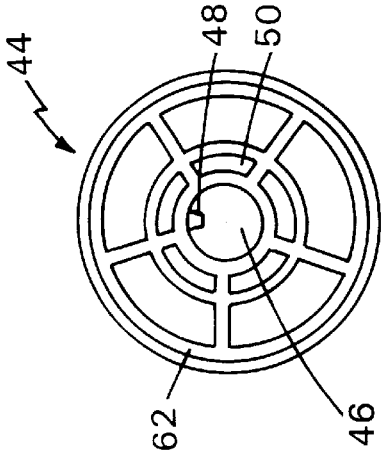
FIG. 6 is an elevational view of one of the two handle guards.
Figure 7:
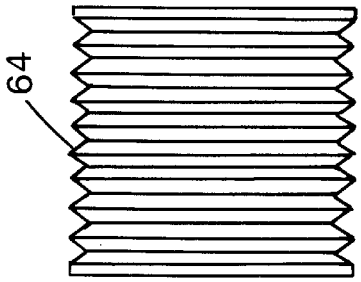
FIG. 7 is a plan view of one of the two resilient rubber boots that permit the reciprocal and twisting motion of each handle while concealing the working parts.

Turning to FIG. 6, an end view of the handle guard 44 is shown. The relationship of keyway 48 to core hole 50 can be seen. One end of the rubber boot 64 shown in FIG. 7 is attached to flat 62 on guard 44. The other end of the rubber boot is attached to an outermost spacer 18 by gluing or by means of another small retaining ring on the inside (not shown). The boot 64 may thus yield flexibly in torsion and compress and expand axially with rotational and reciprocating movements of the handle guard 44.

Figure 8B:
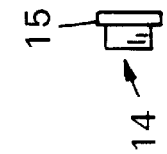
FIGS. 8A, 8B and 8C display, respectively, plan, side and profile views of one of the spring clips employed in assembling the device to assist in the control of the stepwise rotary motion of the rings.
Figure 8A:
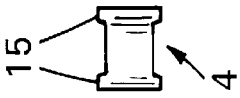
Figure 8C:
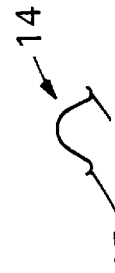

Three views of the spring clip 14 are shown in FIGS. 8A, 8B and 8C, respectively. The clip 14 is used to retain the rotating rings 10 in their proper adjusted positions as shown in FIG. 3. The clips 14 may be metal, stamped out in a metal stamping process, or possibly resilient plastic formed by injection molding. Tabs 15 hold the spring clips 14 onto structural members 34 of the spacing rings 18. The convex side of the clips rest on portions 17A and 17B of the spacer rings (FIG. 3). As a rotating game ring 10 is rotated one step to the left, the tabs on the right side of the spring clip hold the clip in place while the rest of the clip is flexed to the left and downwardly (as seen in the upper portion of FIG. 3) to clear the tooth 12 of the rotating ring. Once the tooth is past the spring clip, the latter snaps and forces itself back into its normal position thereby holding the just rotated ring in its new position.

Figure 9:
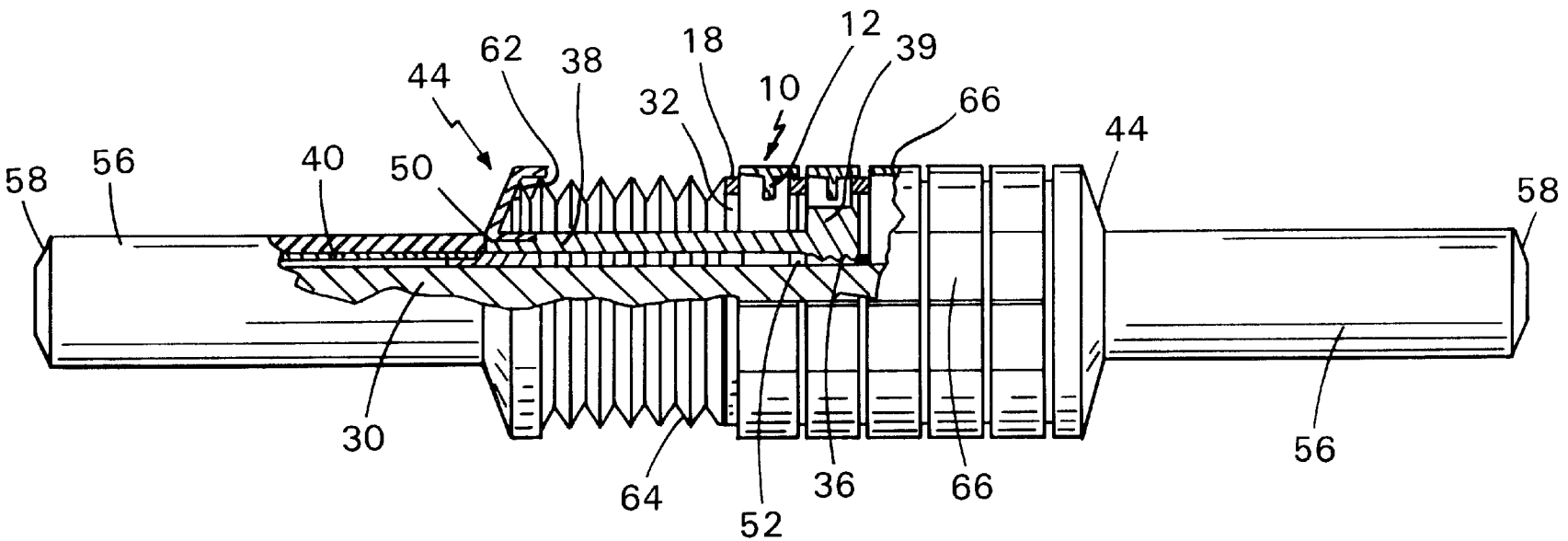
FIG. 9 is a plan view, with portions cut away, showing the parts assembled together in a complete unit.

An assembled cutaway view of the game device is shown in FIG. 9, disclosing the relationship of the assembled components. The surfaces of the rotating game rings may be divided into any number of spaces 66 and any number of icons may be displayed. Also any number or size of rings may be used depending on the version of the game. The basic functioning and assembly of the game would remain the same.

Referring to FIGS. 10–15, another embodiment of a rotating ring game 100 of my invention will now be described. Improvements found in this embodiment include the addition of electronic circuitry to the game for enhanced game play.

Figure 11:
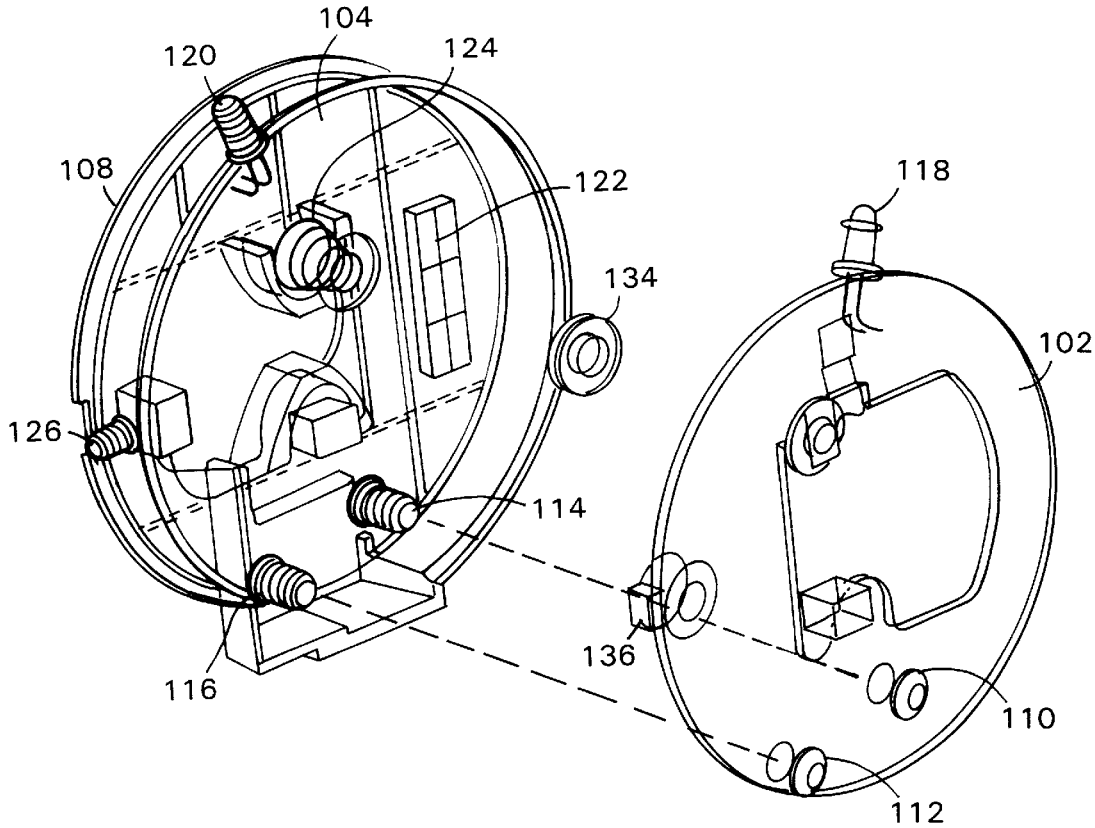
FIG. 11 is an exploded perspective view of a circuit board assembly for the rotating ring game of FIG. 10.
Figure 13A:
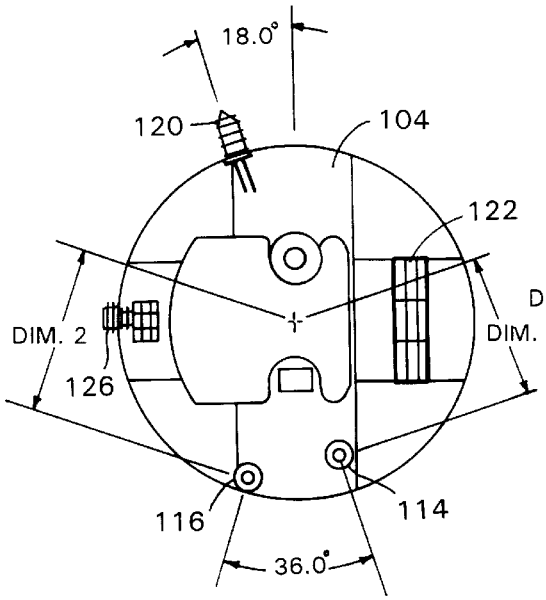
FIGS. 13A and 13B are front and rear views, respectively, of a circuit board for the rotating ring game of FIG. 10.
Figure 13B:
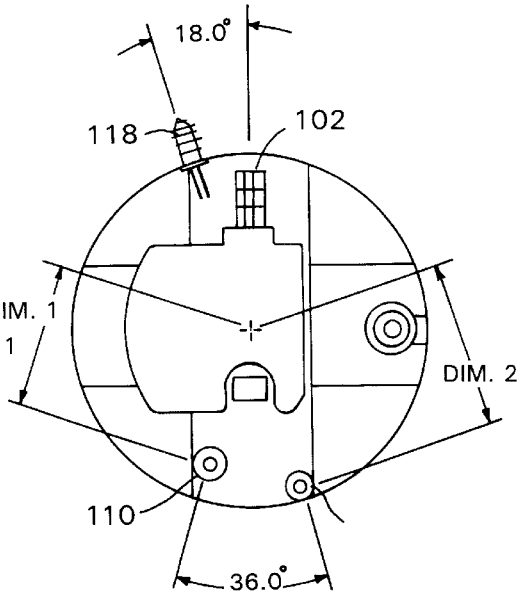
Figure 14:
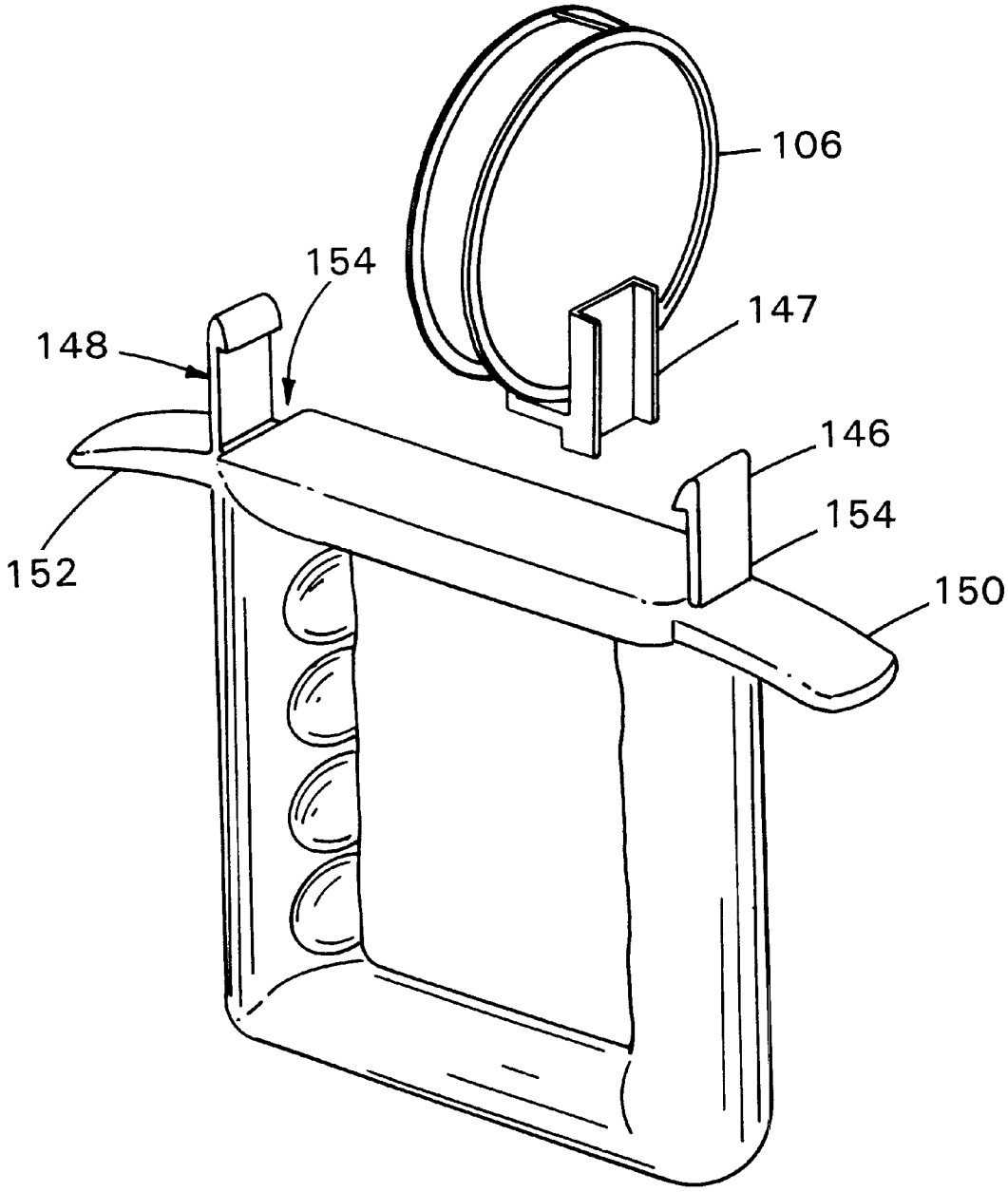
FIG. 14 is an exploded perspective view of the hilt and circuit board cover assembly for the rotating ring game of FIG. 10.

The basic configuration of the improved embodiment of the game consists of two circuit boards 102, 104 (FIGS. 13B and 13A, respectively) placed at the opposite ends of the rotating ring assembly 133. These boards are housed in circuit board covers 106, 108 (FIG. 14 and FIG. 11, respectively). Circuit board 102 has two inwardly facing infrared emitters 110, 112 (FIG. 11). Circuit board 104 has two inwardly facing infrared detectors 114, 116 (FIG. 11) in line with infrared emitters 110, 112, respectively. Light emitting diodes (LEDs) 118, 120 are soldered to the circuit boards 102, 104, as shown in FIG. 13B and FIG. 13A, respectively. During assembly, the LEDs are bent 90° and pushed through apertures provided in the sidewalls of the circuit board covers 106, 108. Additional components mounted to the circuit board 104 include a controller chip 122 (e.g., a Motorola programmable IC), a battery spring terminal 124, assorted driver components (i.e. resistors and capacitors), and a 90°-facing switch 126 mounted on the outer edge of the board. This switch 126 also protrudes through the side of circuit board cover 108.

An important feature of the circuit board assembly is the location and function of the infrared emitter and detector pairs 110/114, 112/116. Infrared emitter 110 and corresponding infrared detector 114 are placed on the circuit board 102, 104, respectively, at a predetermined, unique radial dimension, DIM1, as shown in FIGS. 13A and 13B. Due to space and other limitations, the first pair 110/114 is placed as far out board as possible. The second pair (infrared emitter 112 and corresponding infrared detector 116) are then placed at a different location, rotated about the center, at an angular dimension equal to the angular dimension on the rotating ring/pattern design, e.g., 36°. In addition, this emitter/detector pair 112/116 is located at a unique radial dimension, DIM2, different from DIM1, e.g. typically 0.100 inch less than DIM1.

Figure 12:
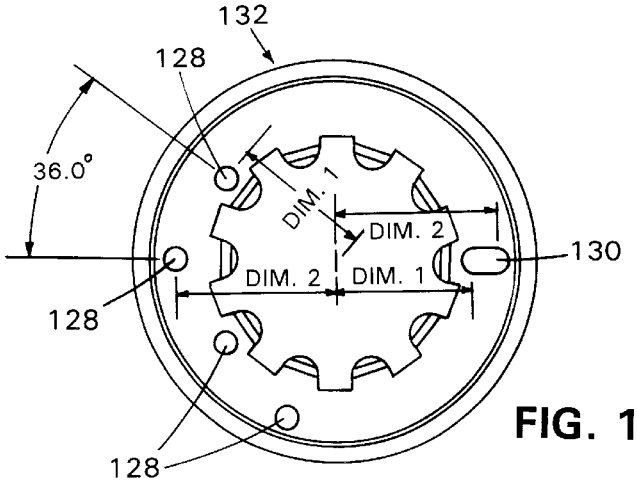
FIG. 12 is an end view of a rotating ring of the rotating ring game of FIG. 10 showing a hole pattern.

The path between emitter/detector pairs 110/114, 112/116 is blocked by the rotating ring 132 of rotating ring assembly 133, spaced between the circuit boards 102, 104. In conjunction with this arrangement, there are unique patterns of holes 128/slot 130 molded into the rotating rings 132, as shown in FIG. 12. Different labels and colors or the like are placed on the outside of the rings 132 so that when a row of like or corresponding icons are lined up, a complete row of corresponding holes 128 in the rotating rings 132 line up between the emitter/detector pairs 110/114, 112/116, thus allowing a complete circuit to be made, which in turn signals a win for the player achieving the desired line up. To provide this result, the different emitter/detector pairs 110/114 and 112/116 are offset in unique radial dimensions DIM1, DIM2, i.e., so the holes 128 that signal a win for "RED" (Player 1) will not signal a win for "BLUE" (Player 2) as they pass the emitter/detector pair for Player 2. The exact location and position of the holes 128/slot 130 patterns in the rotating rings 132 is a function of the number of labels and their position on the game, as determined, e.g., by marketing and desired game play considerations.

The rest of the driver circuits, power supply (i.e., battery 134) and circuitry are standard state of the art technology. This circuit board configuration allows for the following game play: Player 1 starts the game by depressing switch 126. This starts the game by flashing the LED's 118, 120, playing a musical tone or voice recording, and energizing the emitter/detector pairs 110/114, 112/116. Game play continues until one of the two players lines up his corresponding "color", completing the emitter/detector circuit, and achieving indication of the win, e.g., with a preprogrammed sequence of flashing LED's and audible tones, e.g. from piezo buzzer 136. At this point, the game shuts itself off until the next game is started (by pressing switch 126). The game may also be programmed for a finite amount of time for play (e.g., approximately 2 minutes) after which an indication of a draw sequence is initiated.

Referring again to FIG. 10, and also to FIG. 14, a handle or hilt 140 is another enhancement to the playability of this embodiment of the rotating ring game 100 of the invention. The hilt 140 provides a rigid structure for the players to grasp while playing the game. This feature allows the players to move the respective operating handles 142, 144, and the rotating rings 132, independently of actions by the other player. The hilt also permits much more precise and controlled engagement of the rotating rings 132.

The hilt may be formed by gas assist injection molding as one piece. Two snap retention features 146, 148 are integrally molded at the top of the hilt 140, as shown in FIG. 13. These snap features are molded with a slight pre-load so to snap fit securely in place to the snap retention channels 147 of circuit board covers 106, 108 (only cover 106 is shown), with assembly 133 of rotating rings 132 therebetween. Guards 150, 152 are safety features that prevent the players' fingers from being caught or pinched between the ring assembly and handle guard. The rest of the hilt 140 is designed for ergonomics, styling and durability. The hilt may also be molded as a two-piece component, e.g., with a cavity to provide a housing for additional electronics and/or power supply.

Snap retention slots 154 are also defined for precise location and retention of the hilt 140 to the circuit board covers 106, 108 and assembly 133 of rotating rings 132.

Figure 10:
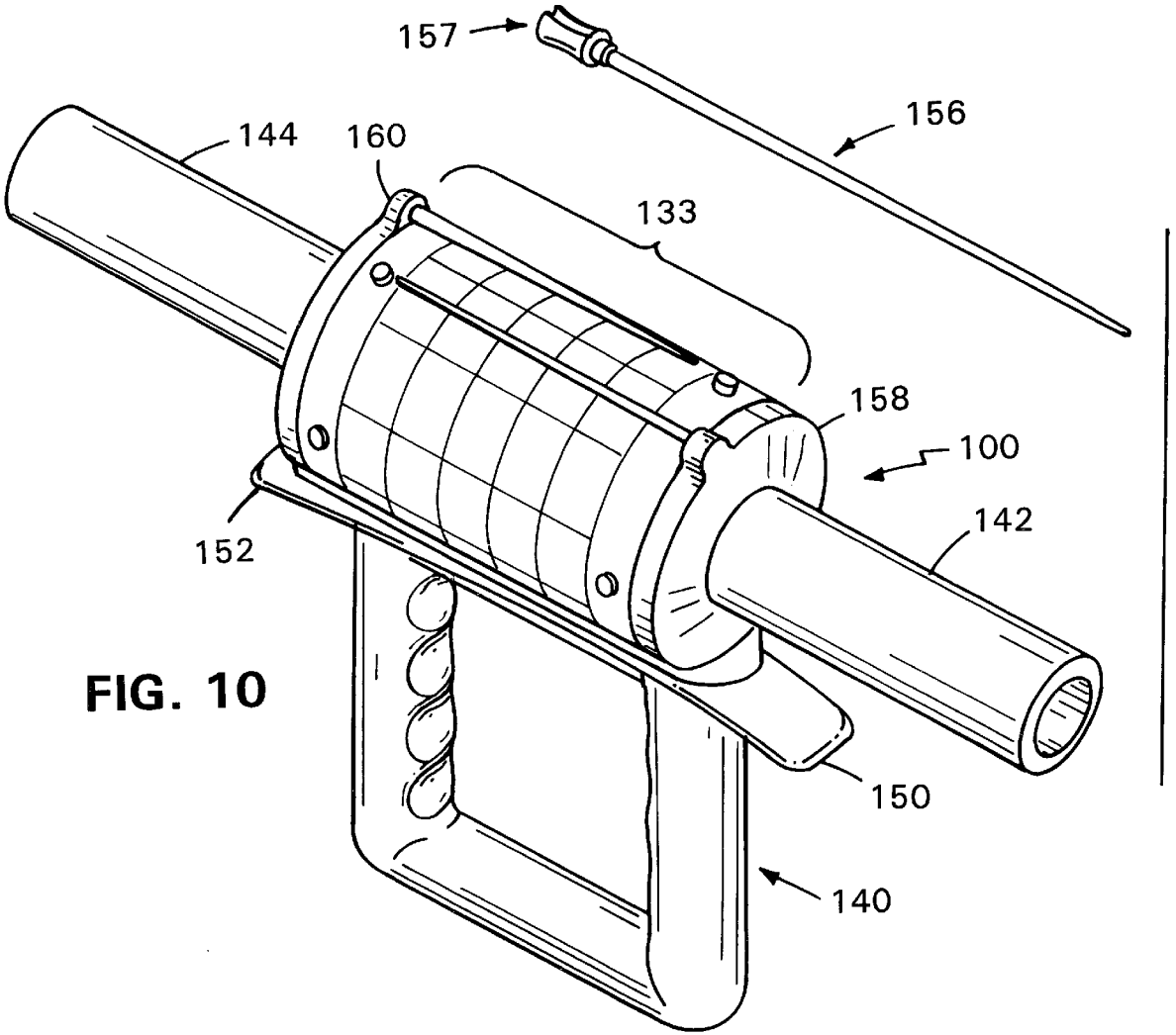
FIG. 10 is an exploded perspective view of another embodiment of the rotating ring game of the invention, with external visual indicators.

Referring to FIG. 10, an external visual indicator 156 (only one of two is shown) is attached to each of the handle guards 158, 160 to allow the players to accurately position their respective handles 142, 144 (and the associated extension tab component 162, described below) during play by visually lining up the tip of the external visual indicators 156 with the specific ring or rings 132 they choose to control. The indicators 156 have a base element 157 for snap fit to the outside surfaces of the handle guards 158, 160 and they are interchangeable with different styles and designs. The indicators 156 are preferably positioned near the top of the handle assembly 170 so the players can see them clearly during game play.

Figure 15:
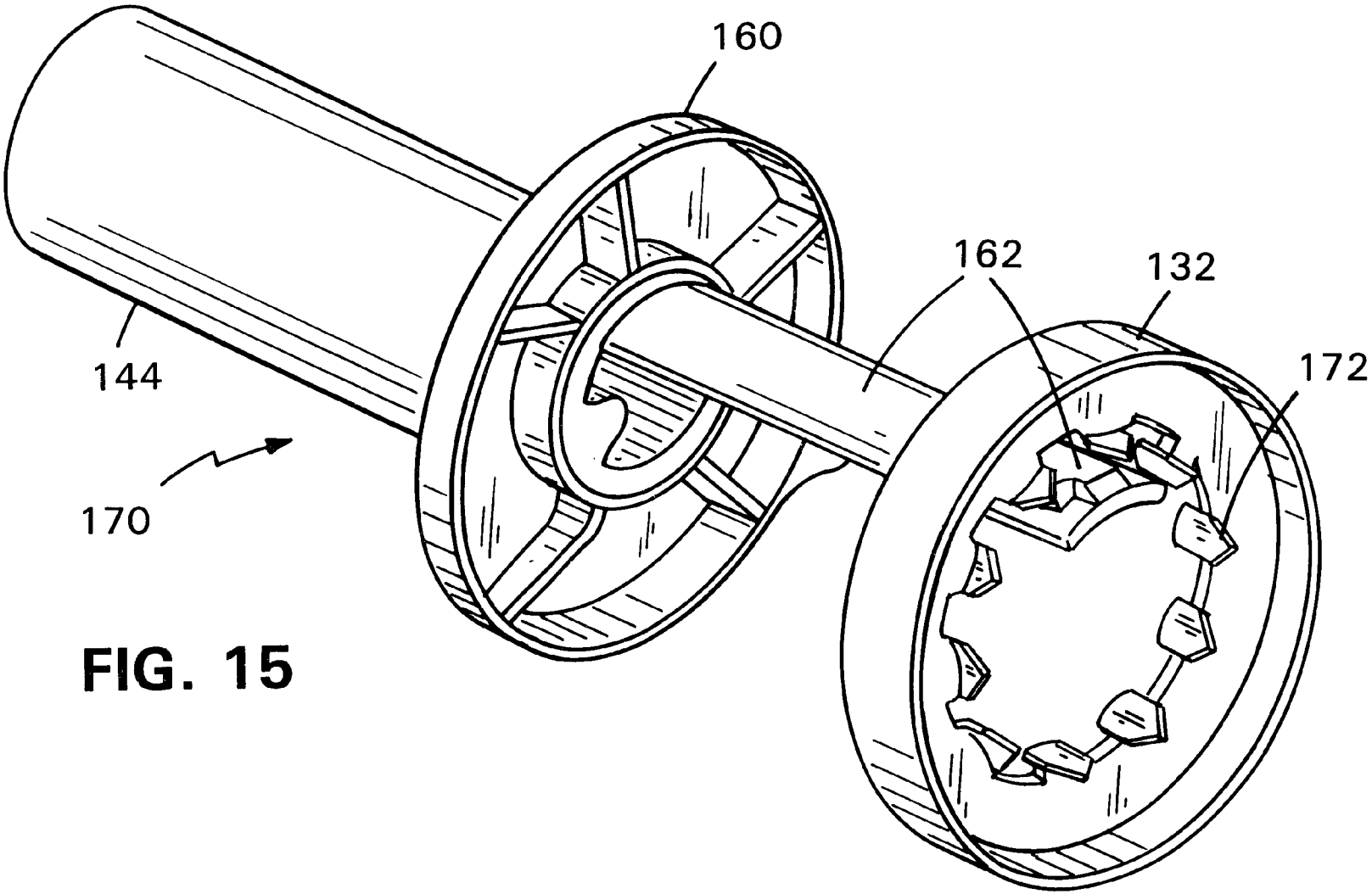
FIG. 15 is a perspective view of the handle assembly engaged with a single rotating ring for the rotating ring game of FIG. 10.

Referring to FIG. 15, each cantilevered extension tab component 162, which preferably is formed by molding with its respective handle guard 158 or 160 and handle 140 or 142 as an integral handle assembly 170, engages the rotating rings 132 (only one is shown). The extension tab component 162 is designed to engage the rotating ring teeth 172, e.g. similar to the earlier embodiment of the game, as described above. However, the extension component 162 is injection molded using a material having durable spring properties, thus to allow the extension component 162 to flex up and down (arrow, T). The extension component 162 is molded with a pre-load, so it applies with continuous pressure into the teeth 172 of the rotating rings 132. As the extension component 162 is slid forward or backward (arrow, U), i.e., via the handle assembly 170, it acts as a spring, flexing down under the teeth 172 of the rotating rings 132 and snapping back up into the teeth 172 of the next rotating ring 132 (not shown). In conjunction with this operation, the extension component 162 is designed to nest into the rotating ring teeth 172. This design allows each player to engage one or two rings 132 simultaneously with equal force and control. The extension component 162 also disengages and slides under the rotating ring 132 when another player is engaging the same ring 132, thus allowing a player that gets to a specific ring 132 first to make the move. This feature provides for smooth game play by reducing or eliminating the blocking or jamming affect sometimes experienced with the earlier version of the game.

While there has herein been disclosed and described presently preferred embodiments of the novel game, it will nevertheless be understood that the same is susceptible of modification and change by those skilled in the art and, therefore, it is not intended the scope of the invention be limited.

A number of embodiments of the invention have been described. Nevertheless, it will be understood that various modifications may be made without departing from the spirit and scope of the invention. For example, the concept of the game of the invention may be embodied in an electronic game, e.g., without rotating rings, or in a computer game. Accordingly, other embodiments are within the scope of the following claims.

What is claimed is:

1. A two player game combining an assembly of ring-form components modifiable by the rotation and sliding of two handles, said two player game comprising first and second handles separated by a series of rotatable game rings, each rotatable game ring in said series of rotatable game rings bearing a pattern of selected indicia about its circumference, first and second game ring engagement members associated with said first and second handles, respectively, and constructed for engagement with and rotation of selected of said rotatable game rings to align selected of said indicia thereon with indicia on adjacent rotatable game rings, by pushing, pulling and rotating movement of said first and second handles about a central common axis, each of said rotatable game rings being free to rotate about said central common axis and held by a series of stationary spacer rings, and an electronic indicator circuit adapted to detect occurrence of a predetermined desired alignment of said indicia and to emit a signal thereupon.

2. The two player game of claim 1, wherein each of said rotatable game rings defines a set of apertures arranged in an aperture pattern corresponding to said pattern of selected indicia about its circumference, and said electronic indicator circuit is adapted to emit said signal when apertures of said series of rotatable game rings are arranged in a predetermined aperture pattern indicating occurrence of said predetermined desired alignment of said indicia.

3. The two player game of claim 2, wherein said electronic indicator circuit comprises a beam emitter and a beam detector, said beam emitter and said beam detector being mounted to said game with said series of rotatable game rings disposed therebetween, and said predetermined aperture pattern indicating occurrence of said predetermined desired alignment of said indicia being positioning of said apertures in a line between said beam emitter and said beam detector.

4. The two player game of claim 3, wherein said line between said beam emitter and said beam detector is disposed generally parallel to said central common axis of said series of rotatable game rings.

5. The two player game of claim 3, wherein said beam emitter comprises an LED emitter and said beam detector comprises an LED detector, said LED detector being positioned to detect an emission from said LED emitter, thereby closing said electronic indicator circuit, when said apertures of said series of rotatable game rings are arranged in said predetermined aperture pattern indicating occurrence of said predetermined desired alignment of said indicia.

6. The two player game of claim 3, wherein said electrical indicator is a piezo buzzer for emitting a sound to indicate said predetermined desired alignment.

7. The two player game of claim 1, further comprising a hilt defining a first surface for gripping by a first player to steady and position said two player game during play and defining a second surface for gripping by a second player to steady and position said two player game during play.

8. The two player game of claim 1, wherein:

said first and second game ring engagement members are extensions of the associated said first and second handles, respectively, each comprising an elastically flexible cantilevered member having a distal actuator portion adapted for engagement with said selected of said rotatable game rings, said distal actuator portion and said rotatable game rings define cooperative interengagement structure, and said elastically flexible cantilevered member is adapted, upon encounter with a predetermined resistance force to rotation of an engaged rotatable game ring, to deflect radially inward, relative to said common central axis, with disengagement of said cooperative engagement structure of said distal actuator portion and said rotatable game rings and to elastically recover radially outward to re-engage said cooperative engagement structure of said distal actuator portion and said rotatable game rings.

9. The two player game of claim 8, wherein said predetermined resistance force is created by opposition between said first engagement member associated with said first handle and said second engagement member associated with said second handle.

10. The two player game of claim 1, wherein said first and second game ring engagement members are constructed for selective, simultaneous engagement with and rotation of multiple of said rotatable game rings.

11. The two player game of claim 1, further comprising first and second externally visible indicator bars coupled to said first and second handles, respectively, and movable therewith in correspondence to said first and second game ring engagement members, each of said first and second externally visible indicator bars comprising a distal indicator portion visually indicating the position of a corresponding said distal actuator portion.

12. A two player game combining an assembly of ring-form components modifiable by the rotation and sliding of two handles, said two player game comprising first and second handles separated by a series of rotatable game rings, each rotatable game ring in said series of rotatable game rings bearing a pattern of selected indicia about its circumference, and first and second game ring engagement members associated with said first and second handles, respectively, and constructed for engagement with and rotation of selected of said rotatable game rings to align selected of said indicia thereon with indicia on adjacent rotatable game rings, by pushing, pulling and rotating movement of said first and second handles about a central common axis, said first and second game ring engagement members being extensions of the associated said first and second handles, respectively, each comprising elastically flexible cantilevered member having a distal actuator portion adapted for engagement with said selected of said rotatable game rings, said distal actuator portion and said rotatable game rings defining cooperative interengagement structure, and said elastically flexible cantilevered member being adapted, upon encounter with a predetermined resistance force to rotation of an engaged rotatable game ring, to deflect radially inward, relative to said common central axis, with disengagement of said cooperative engagement structure of said distal actuator portion and said rotatable game rings and to elastically recover radially outward to re-engage said cooperative engagement structure of said distal actuator portion and said rotatable game rings each of said rotatable game rings being free to rotate about said central common axis and held by a series of stationary spacer rings.

13. The two player game of claim 12, wherein said predetermined resistance force is created by opposition between said first engagement member associated with said first handle and said second engagement member associated with said second handle.

14. A two player game combining an assembly of ring-form components modifiable by the rotation and sliding of two handles, said two player game comprising first and second handles separated by a series of rotatable game rings, each rotatable game ring in said series of rotatable game rings bearing a pattern of selected indicia about its circumference, first and second game ring engagement members associated with said first and second handles, respectively, and constructed for engagement with and rotation of selected of said rotatable game rings to align selected of said indicia thereon with indicia on adjacent rotatable game rings, by pushing, pulling and rotating movement of said first and second handles about a central common axis, said first and second game ring engagement members being extensions of the associated said first and second handles, respectively, each comprising elastically flexible cantilevered member having a distal actuator portion adapted for engagement with said selected of said rotatable game rings/and first and second externally visible indicator bars coupled to said first and second handles, respectively, and movable therewith in correspondence to said first and second game ring engagement members, each of said first and second externally visible indicator bars comprising a distal indicator portion visually indicating the position of a corresponding said distal actuator portion.

* * * * *